US006072453A

United States Patent [19]

Okamoto et al.

[11] Patent Number: 6,072,453

[45] Date of Patent: Jun. 6, 2000

[54] LIQUID CRYSTAL DISPLAY APPARATUS

[75] Inventors: Shigetsugu Okamoto, Kashiwa, Japan; Hirofumi Katsuse, Cowley, United Kingdom

[73] Assignees: Sharp Kabushiki Kaisha, Osaka, Japan; The Secretary of State for Defence in Her Britannic Majesty's Government of the United Kingdom of Great Britain And Northern Ireland, Hants, United Kingdom

[21] Appl. No.: 08/742,033

[22] Filed: Nov. 1, 1996

[30] Foreign Application Priority Data

Nov. 6, 1995 [JP] Japan ..... 7-287667

[51] Int. Cl.[7] ..... G09G 3/36

[52] U.S. Cl. ..... 345/97; 345/94

[58] Field of Search ..... 345/97, 94, 208; 349/172, 178

[56] References Cited

U.S. PATENT DOCUMENTS

| | | | |
|---|---|---|---|
| 4,638,310 | 1/1987 | Ayliffe | 345/97 |
| 4,795,239 | 1/1989 | Yamashita et al. | 345/96 |
| 4,915,477 | 4/1990 | Ohta et al. | 345/94 |
| 4,938,574 | 7/1990 | Kaneko et al. | 345/97 |
| 5,047,758 | 9/1991 | Hartmann et al. | 340/784 |
| 5,459,481 | 10/1995 | Tanaka et al. | 345/95 |
| 5,594,464 | 1/1997 | Tanaka et al. | 345/94 |
| 5,754,154 | 5/1998 | Katakura et al. | 345/97 |
| 5,838,293 | 11/1998 | Kondoh | 345/97 |
| 5,856,815 | 1/1999 | Mochizuchi et al. | 345/97 |

FOREIGN PATENT DOCUMENTS

| | | |
|---|---|---|
| 0632425 | 1/1995 | European Pat. Off. . |
| 5249434 | 9/1993 | Japan . |
| 2249653 | 5/1992 | United Kingdom . |

OTHER PUBLICATIONS

Search Report for Application No. GB 9623137.8; Dated Jun. 6, 1997.

Search Report for Application No. GB 9623137.8 dated Jan. 20, 1997.

Mitsuhiro Koden, "Ferroelectric Liquid Crystal Display", Optronics No. 2 (1994), pp. 52–57.

*Primary Examiner*—Amare Mengistu
*Assistant Examiner*—Vanel Frenez

[57] ABSTRACT

A liquid crystal display apparatus using a ferroelectric liquid crystal with negative dielectric anisotropy in which a blanking pulse having a width that is at least twice of a selecting period and a polarity opposite to a strobe pulse to be applied to a scanning electrode in the selecting period is applied to the scanning electrode before the selecting period during one frame period. Another liquid crystal display apparatus using a ferroelectric liquid crystal with negative dielectric anisotropy in which a strobe pulse is applied to a scanning electrode in a trailing part of the selecting period and a predetermined period that follows the selecting period. A blanking pulse of opposite polarity to the strobe pulse is applied to the scanning electrode before the selecting period in one frame period. A non-selecting period which is at least three times longer than the selecting period is provided between the blanking pulse and the selecting period.

14 Claims, 9 Drawing Sheets

LIQUID CRYSTAL DISPLAY APPARATUS

FIELD OF THE INVENTION

The present invention relates to a liquid crystal display device, and more particularly relates to a liquid crystal display device using ferroelectric liquid crystals (FLC).

BACKGROUND OF THE INVENTION

One known type of a conventional liquid crystal display device is a liquid crystal display device including a liquid crystal layer formed by a ferroelectric liquid crystal (hereinafter referred to as FLC) between transparent substrates respectively having scanning electrodes and signal electrodes arranged in a checker board pattern. Since FLC has spontaneous polarization, the aligned state of molecules has bistability.

The liquid crystal display device using FLC can perform writing at higher speeds compared to a conventional simple matrix liquid crystal display device using nematic liquid crystals or other types of liquid crystals. Such an advantage is gained because the aligned state of FLC is switched by the mutual function of an applied electric field and spontaneous polarization, and FLC molecules have a so-called memory characteristic whereby an aligned state in which an electric field is being applied is retained even after the electric field disappears.

FLC can be classified into two types depending on whether its dielectric anisotropy is positive or negative. The significant difference between these two types of FLC is the relationship between a pulse width ($\tau$) of a drive voltage that effects switching (changes the aligned state) and a pulse height (V), i.e., the $\tau$–V characteristic. FIG. 7(*a*) is a graph showing the $\tau$–V characteristic of FLC having positive dielectric anisotropy, and FIG. 7(*b*) is a graph showing the $\tau$–V characteristic of FLC having negative dielectric anisotropy.

For example, in an ideal driving characteristic when a monopulse is applied as a drive pulse, if the coordinate indicating a combination of the pulse width and pulse height of the drive pulse applied to FLC belongs to a region above the characteristic curve ($\tau$–V curve) shown in FIGS. 7(*a*) and 7(*b*), switching occurs. On the other hand, if the coordinate belongs to a region below the above-mentioned characteristic curve, switching does not occur. For instance, in FLC having positive dielectric anisotropy, when a drive pulse having a uniform pulse width $\tau_1$ shown in FIG. 7(*a*) is applied, if the pulse height of the drive pulse is $V_2$ ($V_2=V_1-V_d$) shown in FIG. 7(*a*), switching does not occur. In this case, switching occurs when the pulse height of the drive pulse is $V_3$ ($V_3=V_1+V_d$).

As is clear from a comparison between FIGS. 7(*a*) and 7(*b*), in FLC having positive dielectric anisotropy, as the pulse height of the drive pulse increases, the pulse width necessary for switching decreases monotonously. In contrast, in FLC with negative dielectric anisotropy, a pulse height ($V_{min}$) at which the pulse width necessary for switching becomes minimum is present, i.e., a so-called $\tau$–$V_{min}$ characteristic is exhibited. Moreover, the slope of the $\tau$–V curve is steeper on a high voltage side higher than $V_{min}$ than on a low voltage side lower than $V_{min}$.

Therefore, in FLC with negative dielectric anisotropy, when a drive pulse having a uniform pulse width $\tau_2$ shown in FIG. 7(*b*) is applied, if the pulse height of the drive pulse is $V_5$ ($V_5=V_4-V_d$) or $V_9$ ($V_9=V_7+V_d$) shown in FIG. 7(*b*), switching does not occur. In this case, switching occurs when the pulse height of the drive pulse is $V_6$ ($V_6=V_4+V_d$) or $V_8$ ($V_8=V_7-V_d$).

More specifically, FLC with negative dielectric anisotropy can be driven by two types of drive schemes: low-voltage drive scheme, and high-voltage drive scheme. In the low-voltage drive scheme, driving is performed by a drive pulse for causing a non-writing voltage (a pulse height that does not effect a switching of FLC) to be applied to a pixel in a selecting period to be lower than a writing voltage (a pulse height which effects a switching of FLC) like the $V_5$–$V_6$ relationship. On the other hand, in the high-voltage drive scheme, the non-writing voltage becomes higher than the writing voltage like the $V_8$–$V_9$ relationship.

As described above, the slope of the $\tau$–V curve on the high voltage side higher than $V_{min}$ is steep. Hence, an advantage of the high-voltage drive scheme is a wide tolerance of slot time due to a big difference between a response speed to the non-writing voltage and a response speed to the writing voltage.

As the low-voltage drive scheme, various schemes are disclosed in "ADDRESSING SCHEMES FOR FERROELECTRIC LIQUID CRYSTAL MATRIX DISPLAYS", C. T. H. Yeoh et al., Ferroelectrics, Vol. 132, pages 293–307 (1992).

On the other hand, examples of the high-voltage drive scheme include the JOERS/Alvey drive scheme disclosed in THE "JOERS/ALVEY" FERROELECTRIC MULTIPLEXING SCHEME, P. W. H. Surguy et al., Ferroelectrics, Vol. 122, pages 63–79 (1991), and so-called Malvern drive scheme described in a laid-open PCT international application, No. WO 92/02925.

The Malvern drive scheme is usually called together with the number of slots of a strobe pulse. For instance, when the strobe pulse is a two-slot strobe, the scheme is called the Malvern-2 scheme. Similarly, when the strobe pulse is a three-slot strobe, it is called the Malvern-3 scheme.

The FLC drive schemes are also classified into two groups: the two-field drive scheme, and the blanking drive scheme. In the two-field drive scheme, one frame period is composed of two fields. In the blanking drive scheme, one frame period is composed of only one field. When FLC is fixed in one stable state for a long time by a DC voltage, it tends not to switch to the other stable state, causing a probability of deterioration of bistability. In order to avoid such an unfavorable condition, in the two-field drive scheme and the blanking drive scheme, the voltages to be applied to the pixels are averaged within one frame.

More specifically, in the two-field drive scheme, when a drive voltage for writing or retaining the alignment of FLC in one of the stable states is applied in the first field, a drive voltage for writing or retaining the alignment of FLC in the other bistable state is applied in the following second field.

On the other hand, in the blanking drive scheme, the alignment of FLC in the pixel region is changed to predetermined one of bistable states by giving the blanking pulse to the scanning electrode before the selecting period so as to blank the pixel. The blanking drive scheme has such an advantage over the two-field drive scheme that the scanning time is reduced to about a half because one frame is formed by one field.

One known conventional blanking drive scheme for FLC having the $\tau$–$V_{min}$ characteristic is called the CY drive scheme. The CY drive scheme is disclosed in the above-mentioned publication "Writing SCHEMES FOR FERROELECTRIC LIQUID CRYSTAL MATRIX DISPLAYS", C. T. H. Yeoh et al., Ferroelectrics, vol. 132, pages 293–307

(1992), and Japanese Publication for Unexamined Patent Application (Tokukaihei) No. 5-249434 (1993). The CY drive scheme is discriminated from the present invention by its characteristic that the blanking pulse has a pulse width which is just twice that of the strobe pulse.

Next, the following description will discuss the application of typical conventional two-field drive schemes such as the JOERS/Alvey drive scheme to the blanking drive scheme. More specifically, a strobe pulse having the same shape as the strobe pulse used in the two-field drive schemes is used, and one frame period is formed by one field by applying a blanking pulse having opposite polarity and equal pulse area to the scanning electrode before the selecting period so as to shorten the scanning time. The data signal to be applied to the signal electrode satisfies the same conditions as those in the two-field drive schemes. A liquid crystal display device using FLC with negative dielectric anisotropy was driven by such blanking drive schemes.

However, as to be explained in detail below, it was found that, in these blanking drive schemes, the tolerance of slot time becomes narrower and accurate switching may not be effected depending on the waveform of the data signal. The slot time referred here is a time forming a single unit of the pulse width of the drive pulse.

First, referring to FIGS. 8 to 10, the following description will explain driving of a liquid crystal display device by a blanking drive scheme adapting the JOERS/Alvey drive scheme.

Shown at the top of FIG. 8 is the waveform of the scanning signal to be applied to the scanning electrode by this blanking drive scheme. As is clear from the waveform, in this blanking drive scheme, one frame period includes a selecting period composed of two slots ($2\tau_s$) and a blanking period of two slots having the same length as the selecting period before the selecting period.

The pulse height of the first slot in the selecting period is 0 V, and a strobe pulse having a pulse height $V_s$ is applied in the second slot. In the blanking period, a blanking pulse having opposite polarity to the above-mentioned strobe pulse, a pulse width of two slots and pulse height $V_b$ is applied.

In this case, the coefficient, $\alpha$, of the pulse height defined as $$\alpha=|V_b/V_s|,$$

and the pulse height and the pulse width of the blanking pulse are determined so that the pulse area of the blanking pulse and the pulse area of the strobe pulse are equal to each other and $\alpha$ is 0.5. The pulse area is the product of the pulse width and the pulse height.

The data signal to be applied to the signal electrode is the same as that in the conventional JOERS/Alvey drive scheme, and represented by bipolar pulses having a cycle of two slots like an example shown in the middle in FIG. 8. When the data signal represents writing data, $-V_d$ is applied in the first slot and $+V_d$ is applied in the second slot. On the other hand, when the data signal represents non-writing data, $+V_d$ is applied in the first slot and $-V_d$ is applied in the second slot.

A potential difference between the scanning signal and the data signal is applied as a drive pulse to the pixel. The waveform of the drive pulse produced at the pixel by the scanning signal and the data signal is shown at the bottom in FIG. 8.

With the use of the drive pulse, a minimum pulse width $\tau_e$ that permits switching by the blanking voltage to be applied to the pixel in the blanking period, a minimum pulse width $\tau_w$ that permits switching by the writing voltage to be applied to the pixel in the selecting period, a maximum pulse width $\tau_n$ that does not permit switching by the non-writing voltage, were measured against the number, K, of slots between the blanking period and the selecting period. The results of the measurements are shown in FIG. 9. In FIG. 9, curves 51, 52, and 53 indicate $\tau_n$, $\tau_e$, and $\tau_w$, respectively.

The minimum ($\tau_{min}$) of the slot time ($\tau_s$) that can effect switching with accuracy is given by a larger pulse width between $\tau_e$ and $\tau_w$. On the other hand, the maximum ($\tau_{max}$) of the slot time ($\tau_s$) is given by $\tau_n$. Accordingly, the tolerance of the slot time $\tau_s$ is a region indicated by hatching in FIG. 9.

Broken lines 54 and 55 in FIG. 9 represent the maximum and minimum of the slot time, respectively, based on the JOERS/Alvey drive scheme as the two-field drive scheme. In the two-field drive scheme, the minimum of the slot time is given by a minimum pulse width that permits switching by the writing voltage.

As is clear from FIG. 9, in the blanking drive scheme adapting the JOERS/Alvey drive scheme, the value of the minimum of the slot time increases compared to the original two-field drive scheme. Moreover, the value of the maximum of the slot time decreases compared to the original two-field drive scheme. Thus, the tolerance of the slot time becomes narrower considerably.

Here, the problems caused by the narrower tolerance of the slot time will be discussed. One of the characteristics of FLC is that the response speed to the drive voltage varies depending on a change in the ambient temperature. FIG. 10 is a graph showing how the minimum and maximum of the slot time vary depending on the ambient temperature by fixing the number, K, of slots between the blanking period and the selecting period to a uniform value. Curves 61 and 62 in FIG. 9 indicate changes in the maximum $\tau_{max}$ and the minimum $\tau_{min}$, respectively.

When the slot time is fixed to a given value $\tau_s$, the range of ambient temperature within which driving can be performed with $\tau_s$ is between $T_{min}$ and $T_{max}$ shown in FIG. 10. Namely, as the space between the curves 61 and 62 is reduced, i.e., as the tolerance of the slot time becomes narrower, the temperature range within which driving can be performed becomes narrower. When the ambient temperature is out of the above-mentioned range, switching of FLC molecules is imperfect, causing problems such as a lowered contrast ratio and improper display.

In addition, another blanking drive scheme was tested by applying to the scanning electrode a strobe pulse with a pulse width of not less than two slots in a trailing part of the selecting period and a period that follows the selecting period and applying to the scanning electrode a blanking pulse having a polarity opposite to and the same pulse area as the strobe pulse so as to erase the pixel like the above-mentioned Malvern drive scheme. In this scheme, even when the data signal applied to the signal electrode in the selecting period was the non-writing data, switching of FLC sometimes occurred in the vicinity of the selecting period. Accordingly, this scheme suffers from a drawback that there is a possibility of failing to obtain a desired display result.

SUMMARY OF THE INVENTION

An object of the present invention is to improve the response speed in a liquid crystal display device using FLC without lowering the contrast ratio and narrowing the temperature range that permits driving.

In order to achieve the above object, a liquid crystal display device of the present invention includes:

a first substrate having a plurality of parallel scanning electrodes arranged thereon;

a second substrate having a plurality of parallel signal electrodes arranged thereon to cross the scanning electrodes at right angles;

a ferroelectric liquid crystal with negative dielectric anisotropy sandwiched between the first and second substrates;

scanning electrode driving means for applying to the scanning electrodes a scanning signal having a cycle of one frame period during which all of the scanning electrodes are selected once, the scanning signal including a strobe pulse in a selecting period, and a blanking pulse as a unipolar pulse having a polarity opposite to the strobe pulse, a width which is at least twice longer than the selecting period, and a uniform pulse height in a blanking period located before the selecting period; and signal electrode driving means for applying a data signal to the signal electrodes, the data signal including writing data and non-writing data represented by bipolar pulses having a duration equal to the selecting period, a uniform pulse height, and different waveforms, wherein when the data signal represents the writing data, a potential difference between the scanning signal and the data signal in a slot synchronous with the strobe pulse is a writing voltage for changing an alignment of the ferroelectric liquid crystal to one of bistable states, when the data signal represents the non-writing data in the slot, the potential difference is a non-writing voltage which does not change the alignment of the ferroelectric liquid crystal, and a potential difference between the blanking pulse and the data signal includes a blanking voltage for changing the alignment of the ferroelectric liquid crystal to the other state of the bistable states.

In this structure, in the selecting period, when the data signal represents writing data, the potential difference between the strobe pulse to be applied to the scanning electrode and the data signal to be applied to the signal electrode serves as a writing voltage for switching the alignment of the ferroelectric liquid crystal. When the data signal represents non-writing data, the above-mentioned potential difference serves as a non-writing voltage that does not switch the alignment of the ferroelectric liquid crystal. Assuming that the aligned state of ferroelectric liquid crystal when the writing voltage is applied in the selecting period is the first state of the bistable states, the blanking pulse that is applied to the scanning electrode before the selecting period brings the aligned state of ferroelectric liquid crystal into the second state. Namely, the pixel is blanked before the selecting period, and the alignment of FLC in a pixel to which writing is performed is switched but the alignment of FLC in a pixel to which writing is not performed is retained during the selecting period. Consequently, each scanning electrode is selected once in one frame period. This structure permits driving at higher speeds compared to a conventional two-field drive scheme in which two fields are required per frame period.

The minimum of the slot time (a single unit of the pulse width of a drive pulse) in driving the ferroelectric liquid crystal is given by a larger response time between a response time to the blanking voltage and a response time to the writing voltage in the selecting period. In this structure, by blanking the pixel with the application of the blanking pulse before the selecting period, the switch of the alignment of ferroelectric liquid crystal in a period during which the blanking pulse is applied (hereinafter referred to as "blanking period") affects the selecting period. More specifically, the above-mentioned structure has such an advantage that the aligned state of ferroelectric liquid crystal easily switches when the writing voltage is applied in the selecting period. Consequently, in this structure, compared to the structure where the blanking pulse is not applied, the response time to the writing voltage in the selecting period is shortened.

On the other hand, since the duration of the blanking period is arranged to be at least twice that of the selecting period, the response time to the blanking voltage can be made shorter than the response time to the writing voltage in the selecting period. More specifically, the blanking pulse is a unipolar pulse having a uniform pulse height, and two types of data signals, i.e., writing data and non-wiring data, are represented by bipolar pulses having the same duration as the selecting period and a uniform pulse height. Therefore, the blanking pulse of two or more slots is always generated in the blanking period irrespectively of the type of the data signal in the blanking period. It is thus possible to increase the frequency of generating the blanking voltage. As a result, the switch of the alignment of ferroelectric liquid crystal in the blanking period is facilitated, and the response time to the blanking voltage becomes shorter than the response time to the writing voltage in the selecting period.

As described above, in this structure, both the response time to the blanking voltage and the response time to the writing voltage become smaller. Consequently, the minimum of the slot time decreases, resulting in an improvement of the response speed.

The maximum of the slot time is given by the response time to the non-writing voltage in the selecting period. In this structure, by blanking the pixel with the blanking pulse before the selecting period, a switch of the alignment upon the application of the non-writing voltage is facilitated. As a result, the maximum of the slot time decreases. However, as mentioned above, since the minimum of the slot time also decreases, the tolerance of the slot time is not narrowed. It is thus possible to provide a liquid crystal display device capable of being driven at high speeds in a wider temperature range.

In such a liquid crystal display device, if a compensating pulse having opposite polarity to the blanking pulse and a pulse area equal to the difference between the pulse area of the blanking pulse and that of the strobe pulse is applied to the scanning electrode by the scanning electrode driving means in a period that follows the selecting period and precedes the next blanking pulse, the difference between the pulse area of the blanking pulse and that of the strobe pulse is compensated by the compensating pulse, and the voltages of the scanning signals in one frame period can be averaged zero. The pulse area is a product of the pulse width and the pulse height. Since the data signal is formed by bipolar pulses having a uniform pulse height, the average voltage in one flame period is zero. Consequently, by applying the compensating pulse to the scanning signal as mentioned above, the voltage to be applied to the ferroelectric liquid crystal in the pixel region is made equal to prevent electrochemical degradation of liquid crystal. In addition, since the compensating pulse is applied over a period that follows the selecting period and precedes the next blanking pulse, the compensating pulse does not affect the switching characteristics of the ferroelectric liquid crystal in the selecting period.

In order to achieve the above object, another liquid crystal display device of the present invention includes:

a first substrate having a plurality of parallel scanning electrodes arranged thereon;

a second substrate having a plurality of parallel signal electrodes arranged thereon to cross the scanning electrodes at right angles;

a ferroelectric liquid crystal with negative dielectric anisotropy sandwiched between the first and second substrates;

scanning electrode driving means for applying to the scanning electrodes a scanning signal having a cycle of one frame period during which all of the scanning electrodes are selected once, the scanning signal including a strobe pulse in a part of a selecting period of the scanning electrode and a following predetermined period, and a blanking pulse having a polarity opposite to the strobe pulse in a period preceding the selecting period; and signal electrode driving means for applying a data signal to the signal electrodes, the data signal including writing data and non-writing data represented by bipolar pulses having a duration equal to the selecting period, a uniform pulse height, and different waveforms, wherein when the data signal represents the writing data, the potential difference between the scanning signal and the data signal in a slot synchronous with the strobe pulse is a writing voltage for changing an alignment of the ferroelectric liquid crystal to one of bistable states, when the data signal represents the non-writing data in the slot, the potential difference is a non-writing voltage which does not change the alignment of the ferroelectric liquid crystal, the potential difference between the blanking pulse and the data signal includes a blanking voltage for changing the alignment of the ferroelectric liquid crystal into the other state of the bistable states, and a non-selecting period which is at least three times longer than the selecting period is present between the blanking pulse and the selecting period.

In this structure, since the non-selecting period having a duration at least three times longer than the selecting period is given between the blanking pulse and the selecting period, it is possible to reduce the effect of the switch of the alignment of ferroelectric liquid crystal caused by the blanking pulse on the aligned state of ferroelectric liquid crystal in the vicinity of the selecting period to an allowable range. The non-selecting period is a period during which both of the blanking pulse and the strobe pulse are not applied.

More specifically, when the interval between the blanking period and the selecting period is short, the alignment of ferroelectric liquid crystal easily switches in the vicinity of the selecting period due to the switch of the alignment of ferroelectric liquid crystal caused by the blanking pulse in the blanking period. Therefore, like the above-mentioned structure, when the strobe pulse continues for another predetermined period after the selecting period, if the data signal immediately after the selecting period is writing data, the writing voltage is applied to the pixel immediately after the selecting period. Accordingly, there is a possibility that a spurious switching is caused by the writing voltage immediately after the selecting period even if the data signal in the selecting period is non-writing data. In order to solve such a problem, in the above-mentioned structure, a non-selecting period that is at least three times longer than the selecting period is arranged between the blanking pulse and the selecting period. This arrangement prevents a spurious switching due to the effect of a switching caused by the blanking pulse on the switching characteristic of ferroelectric liquid crystal in the vicinity of the selecting period. It is thus possible to provide a liquid crystal display device having high contrast ratio and high response speed.

For a fuller understanding of the nature and advantages of the invention, reference should be made to the ensuing detailed description taken in conjunction with the accompanying drawings.

DESCRIPTION OF THE PREFERRED EMBODIMENTS

Embodiment 1

One embodiment of the present invention will be discussed with reference to FIGS. 1 to 4.

Figure 2:
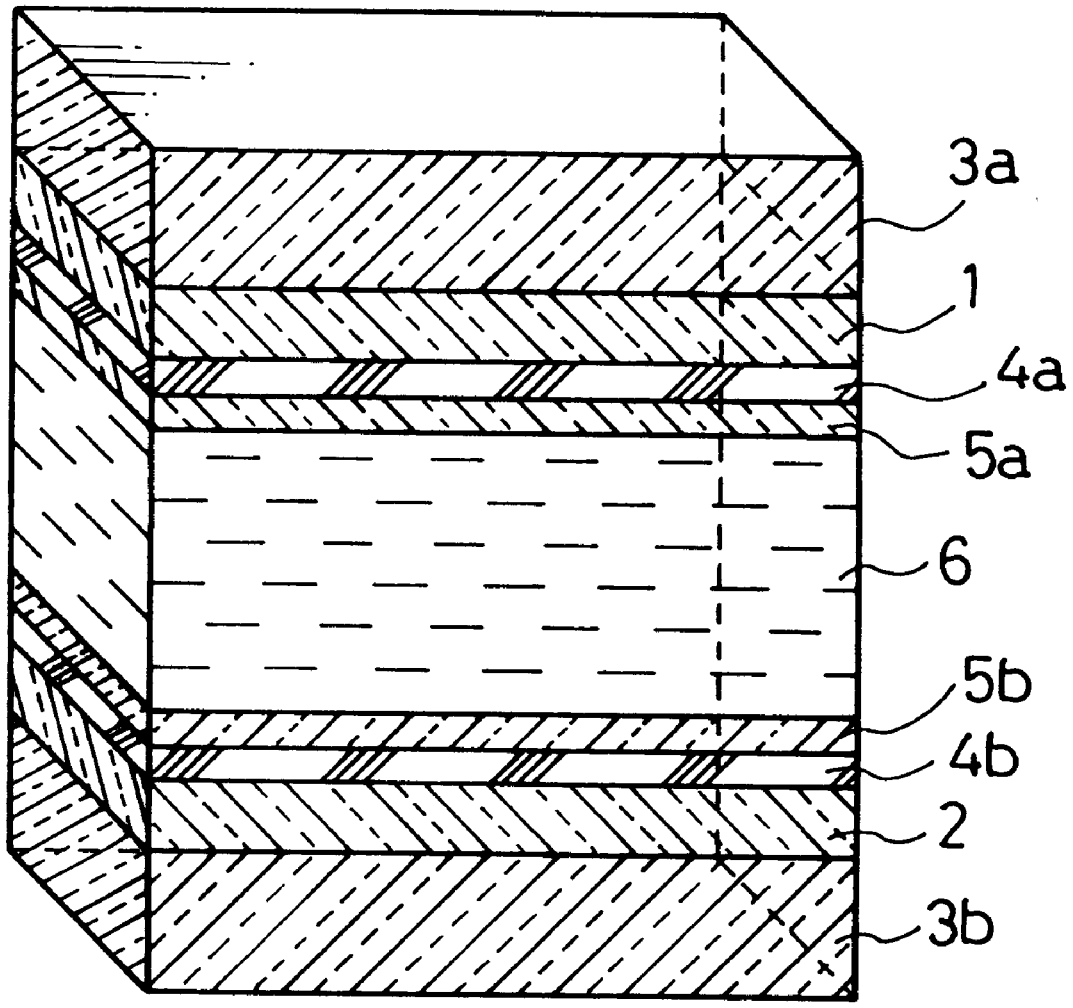
FIG. 2 is a cross section showing the structure of a liquid crystal cell in the liquid crystal display device.

First, referring to FIG. 2, the following description will discuss the structure of a liquid crystal cell in a liquid crystal display device using a ferroelectric liquid crystal as an embodiment of the present invention. The liquid crystal cell shown in FIG. 2 corresponds to one pixel of a liquid crystal panel of the liquid crystal display device. As to be described later, the liquid crystal cell is a section to be the lattice point of scanning electrodes and signal electrodes arranged in a checker board pattern.

As illustrated in FIG. 2, the liquid crystal panel includes two pieces of transparent substrates 3*a* and 3*b*. On a surface of the transparent substrate 3*a*, scanning electrodes 1, an insulating film 4*a*, and a rubbed alignment film 5*a* are layered in this order. On the other hand, signal electrodes 2, an insulating film 4*b*, and a rubbed alignment film 5*b* are layered in this order on a surface of the transparent substrate 3*b*. The transparent substrates 3*a* and 3*b* are fastened to face each other so that a space of about 1.5 μm is produced between the alignment films 5*a* and 5*b*. By filling a ferroelectric liquid crystal with negative dielectric anisotropy into the space, a liquid crystal layer 6 with a thickness of about 1.5 μm is formed between the transparent substrates 3*a* and 3*b*.

More specifically, the scanning electrodes 1 are formed in a stripped pattern on the surface of the transparent substrate 3*a*. Similarly, the signal electrodes 2 are formed in a stripped pattern on the surface of the transparent substrate 3*b*. The transparent substrates 3*a* and 3*b* are positioned so that the scanning electrodes 1 and the signal electrodes 2 cross each other at right angles.

A differential voltage between a scanning signal applied to the scanning electrode 1 and a data signal applied to the signal electrode 2 is applied as a pixel voltage for driving a pixel to each pixel that is the lattice point of the scanning electrode 1 and the signal electrode 2. Each pixel can display either of dark and bright states when the alignment of ferroelectric liquid crystal molecules is switched into either of two stable states depending on the polarity, amplitude and a pulse waveform of a pixel voltage applied.

Figure 3:
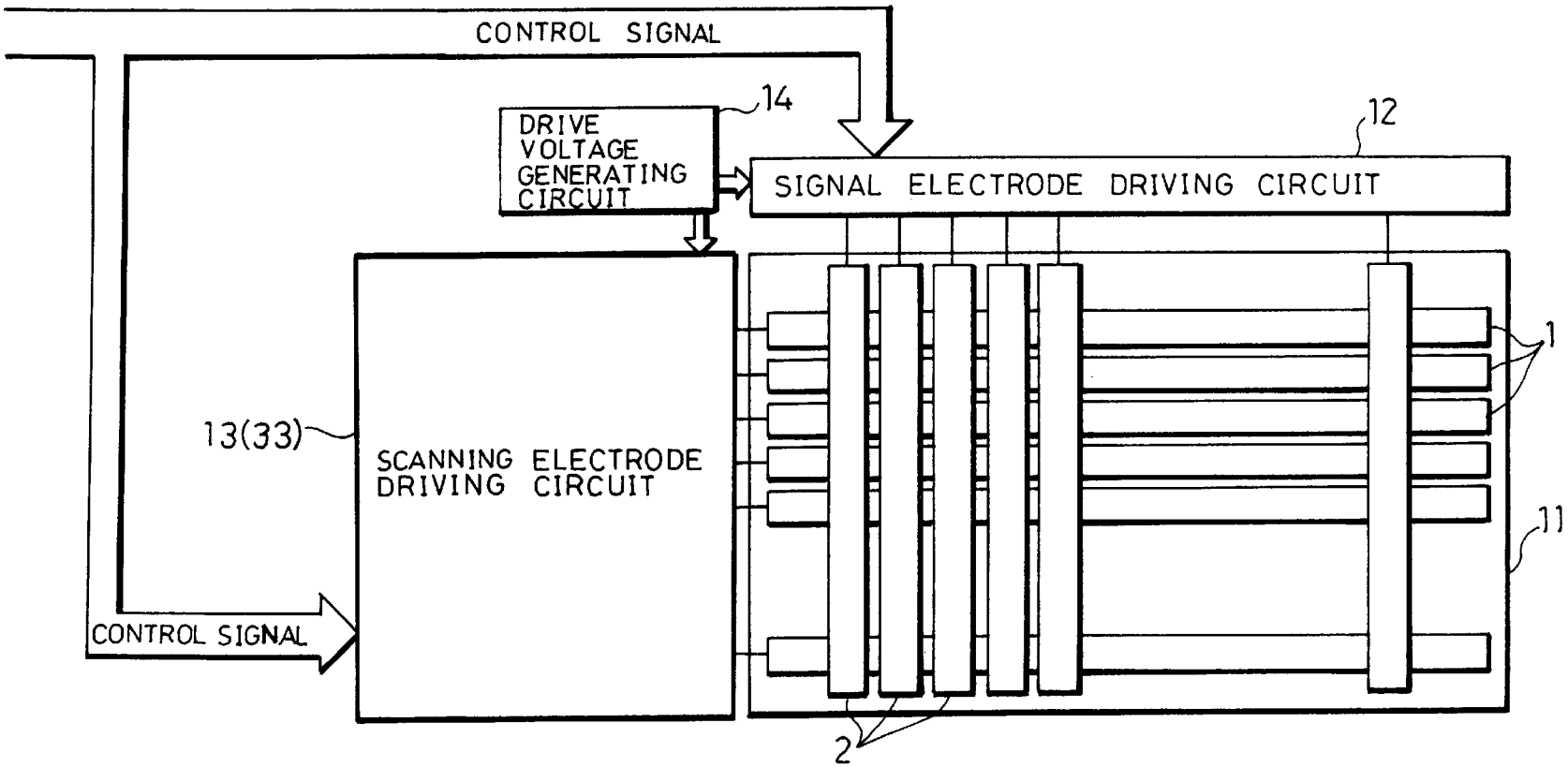
FIG. 3 is a block diagram showing the structure of a driving system in the liquid crystal display device.

FIG. 3 is a view explaining a schematic structure of a driving system of the liquid crystal display device of this embodiment. As illustrated in FIG. 3, the liquid crystal display device includes a liquid crystal panel 11 having the above-mentioned cell structure. Moreover, in order to drive the liquid crystal panel 11, the liquid crystal display device is provided with a scanning electrode driving circuit 13 as scanning electrode driving means for applying scanning signals to the scanning electrodes 1 of the liquid crystal panel 11, a signal electrode driving circuit 12 as signal electrode driving means for applying data signals to the signal electrodes 2, and a drive voltage generating circuit 14.

The scanning electrode driving circuit 13 and the signal electrode driving circuit 12 produce the scanning signal and data signal based on a voltage having varing pulse height generated by the drive voltage generating circuit 14, a pulse width and application timing given by a control signal. The pulse waveforms thus produced are applied to the scanning electrodes 1 and the signal electrodes 2, respectively.

Figure 1:
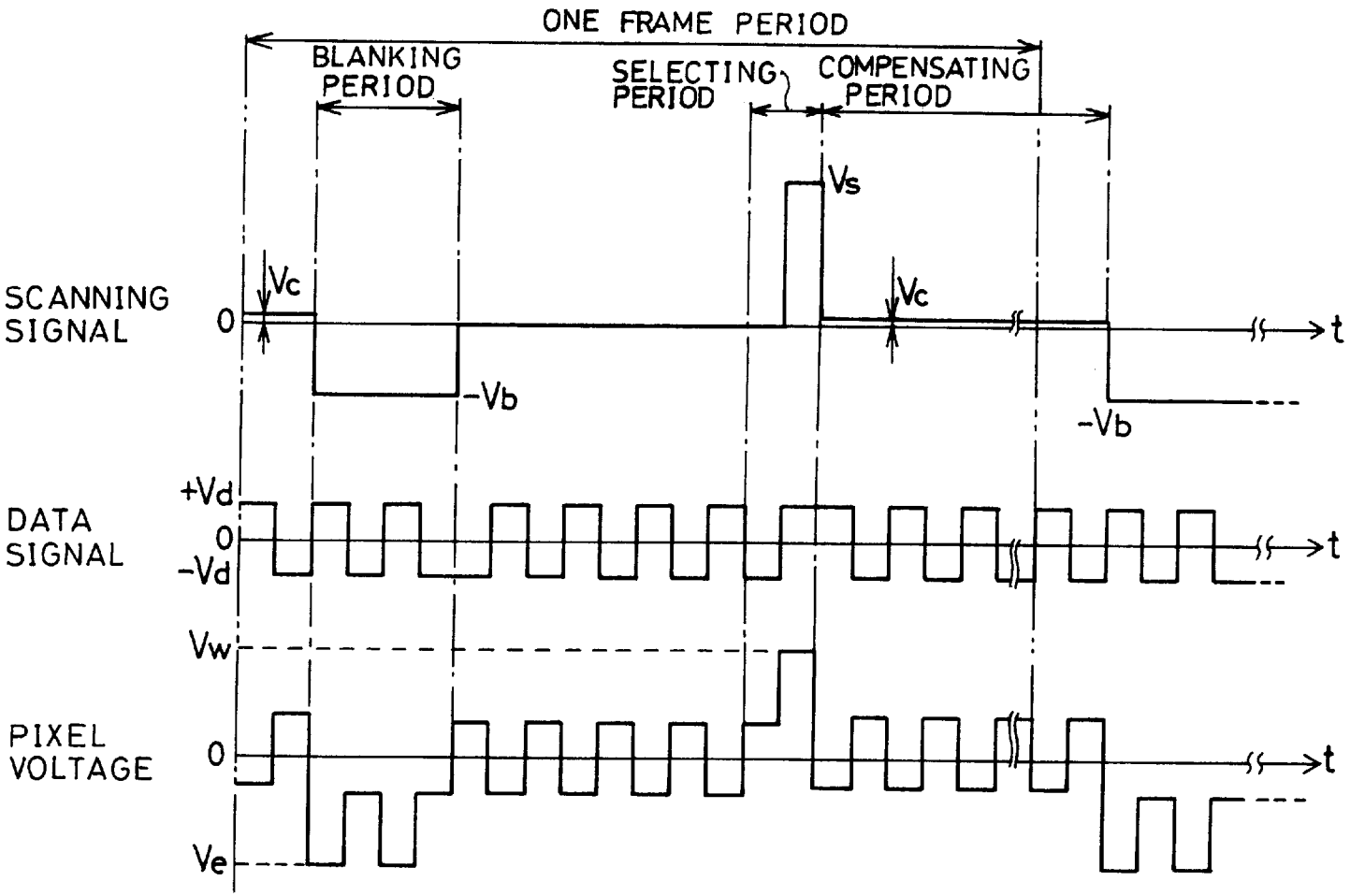
FIG. 1 is a waveform chart showing an example of a scanning signal, a data signal, and a pixel voltage produced at a pixel by these signals in a liquid crystal display device according to one embodiment of the present invention.

Referring now to FIG. 1, the following description will explain the waveforms of the scanning signal and data signal to be applied to the scanning electrode 1 and the signal electrode 2 by the scanning electrode driving circuit 13 and the signal electrode driving circuit 12, respectively, and the waveform of the pixel voltage produced at the pixel by these signals.

An example of the waveform of the scanning signal to be applied to the scanning electrode 1 by the scanning electrode driving circuit 13 is shown as the top waveform in FIG. 1. One cycle (one frame period) of the scanning signal is a period during which all of the scanning electrodes 1 are selected once. In one frame period, a period during which each scanning electrode 1 is selected, i.e., a selecting period, is two slots ($2\tau_s$).

As shown by the waveform, in one frame period, the scanning signal has a selecting period with a duration of two slots ($2\tau_s$) wherein a strobe pulse ($V_s$) is applied in the second slot, and a blanking period with a duration of four slots ($4\tau_s$) during which a blanking pulse ($-V_s$) is applied, before the selecting period.

The period between the selecting period and the next blanking period is called a compensating period as shown in FIG. 1. A compensating pulse ($V_c$) is applied to the scanning electrode 1 over the compensating period. The function of the compensating pulse is to average out the pixel voltages to be applied to the pixels at ±0 so as to prevent electrochemical degradation of liquid crystal molecules as to be described later.

FIG. 1 shows one example in which the pulse width of the blanking pulse, i.e., the duration of the blanking period, is four slots. The duration of the blanking period is not necessarily limited to this value, but must be at least twice that of the selecting period.

The data signal to be applied to the signal electrode 2 by the signal electrode driving circuit 12 represents information of display data of one bit by bipolar pulses having a cycle of two slots. In this embodiment, in a data signal representing writing data, the first slot is $-V_d$, and the second slot is $+V_d$. The bipolar pulses are called "a writing pattern". On the other hand, in a data signal representing non-writing data, the first slot is $+V_d$, and the second slot is $-V_d$, forming "a non-writing pattern". An example of the waveform of the data signal is shown as the middle waveform in FIG. 1.

A pixel as the minimum unit for making a display on the liquid crystal panel 11 corresponds to the lattice point of the scanning electrode 1 and the signal electrode 2. The potential difference between the scanning signal to be applied to the scanning electrode 1 and the data signal to be applied to the signal electrode 2 serves as the pixel voltage for driving the pixel.

For instance, a pixel voltage produced by the scanning signal shown at the top in FIG. 1 and the data signal shown in the middle has the waveform shown in the bottom. In this case, the data signal in the selecting period forms the writing pattern, and the writing voltage $V_w$ to be applied to the pixel in the second slot of the selecting period is given by $$V_w=V_s-V_d \tag{1}$$

On the contrary, when the data signal forms the non-writing pattern, the non-writing voltage $V_n$ to be applied to the pixel in the second slot of the selecting period is given by $$V_n=V_s+V_d \tag{2}$$

Further, in this case, as is clear from the bottom waveform in FIG. 1, a voltage $V_e$ which has the same pulse height as and the opposite polarity to the writing voltage $V_w$ is produced in the first slot and the third slot of the blanking period. The function of the voltage $V_e$ is to align the ferroelectric liquid crystal molecules in the pixel region into a predetermined one of bistable states. The voltage $V_e$ is hereinafter referred to as the blanking voltage. When the writing voltage $V_w$ is applied, the ferroelectric liquid crystal molecules are aligned to achieve the other state of the bistable states. The blanking voltage $V_e$ is given by $$V_e=-V_b-V_d \tag{3}$$

Namely, each pixel of the liquid crystal display device of this embodiment is driven in one frame period as follows. First, the liquid crystal molecules in the pixel region are aligned to produce predetermined one of the bistable states by the blanking voltage in the blanking period. As a result, the pixel is displayed in either of predetermined dark and bright states. Thereafter, when the writing voltage is applied in the selecting period, the alignment of liquid crystal molecules in the pixel region switches, and the pixel is displayed in the state opposite to that in the blanking period. On the other hand, when the non-writing voltage is applied in the selecting period, the alignment of liquid crystal molecules in the pixel region does not switch, and therefore the display state in the blanking period is retained.

The pulse heights of the above-mentioned blanking pulse, strobe pulse, and data signal are determined to satisfy the following conditions. First, the coefficient, $\alpha$, of the pulse height of the blanking pulse is defined as $$\alpha=|V_b/V_s| \tag{4}$$

Then, equation (5) is given by equations (3) and (4) above.

$$V_e=-\alpha\cdot V_s-V_d \tag{5}$$

In order to equalize the pulse height of the blanking voltage and the writing voltage, equation (6) is given.

$$|V_e|=|V_w| \tag{6}$$

Further, $\alpha$ is limited within the following range.

$$0<\alpha<1 \tag{7}$$

Then, $\alpha$ is given by $$\alpha=1-2\cdot V_d/V_s \tag{8}$$

If $\alpha$=0.5, it can be said from equations (4) and (8) that the relationship among the amplitudes of the blanking pulse, strobe pulse and data signal is written:

$$V_d:V_b:V_s=1:2:4 \tag{9}$$

The reason why equalizing the pulse height of the blanking voltage $V_e$ and the writing voltage $V_w$ as shown in equation (6) and setting the coefficient $\alpha$ to 0.5 in calculating the relationship of the pulse heights of $V_d$, $V_b$, and $V_s$ is to minimize the number of parameters that are need to be considered and ease the control of the driving system of the liquid crystal display device.

Moreover, the pulse height $V_c$ of the compensating pulse is defined as $$V_c=V_s(0.5\tau_b-\tau_s)/\{\tau_N-(2+K)\tau_s-\tau_b\} \tag{10}$$

where K is the number of slots between the blanking period and the selecting period, $\tau_N$ is the duration of one frame, and $\tau_b$ is the pulse width of the blanking pulse.

As is clear from equations (1) and (2), the non-writing voltage $V_n$ is greater than the writing voltage $V_w$ in the selecting period. Namely, the liquid crystal display device of this embodiment utilizes the characteristic on the high-voltage side higher than $V_{min}$ in the $\tau-V_{min}$ curve showing the characteristics of ferroelectric liquid crystal with negative dielectric anisotropy in the selecting period so that the non-writing voltage $V_n$ is greater than the writing voltage $V_w$.

In contrast, as shown in the bottom of FIG. 1, in a period other than the selecting period, i.e., the non-selecting period (including the blanking period and the compensating period), the alignment of the liquid crystal molecules in the pixel region switches when the blanking voltage $V_e$ is applied to the pixel, but does not switch when a pulse having a pulse height lower than the blanking voltage $V_e$ is applied (for example, in a period between the blanking period and the selecting period). Namely, in the non-selecting period, the liquid crystal display device of this embodiment uses the characteristic on the low-voltage side lower than $V_{min}$ in the $\tau-V_{min}$ curve.

Figure 4:
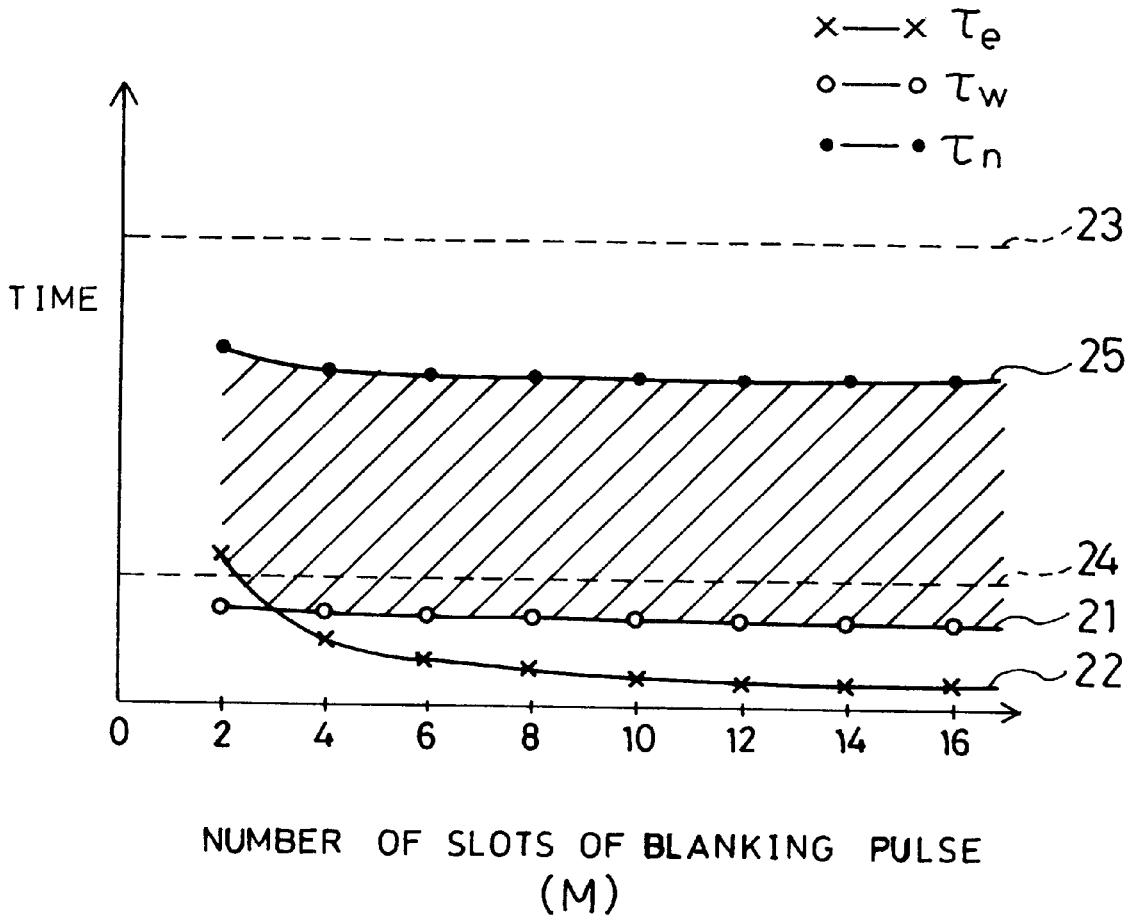
FIG. 4 is a graph showing a response time to a writing voltage, a response time to a non-writing voltage, and a response time to a blanking voltage in the liquid crystal display device in comparison with those in a liquid crystal display device that is driven by a conventional two-field drive scheme.

With the use of the scanning signal and data signal satisfying the conditions of equations (9) and (10), the response time $\tau_e$ to the blanking voltage and the response time $\tau_w$ to the writing voltage were measured by varying the pulse width of the blanking pulse. The results are shown in FIG. 4. More specifically, the measurement was performed using a surface stabilized liquid crystal cell having the structure shown in FIG. 2 and the 1.5 $\mu$m thick liquid crystal layer 6 under the conditions: $V_s$=32 V, $V_b$=16 V, and $V_d$=8 V.

In this case, the waveform (the combination of writing pattern and non-writing pattern) of the data signal to be applied in the blanking period and selecting period, respectively, was varied to find a waveform with the least possibility of switching the alignment of liquid crystal molecules. The response time $\tau_e$ and the response time $\tau_w$ are the minimum response time measured with the above waveform.

In FIG. 4, the scale on the horizontal axis indicates the number of slots, M, of the blanking pulse. A curve 21 represents the response time $\tau_w$ to the writing voltage, a curve 22 is the response time $\tau_e$ to the blanking voltage, and a curve 25 indicates the response time $\tau_n$ to the non-writing voltage.

The minimum ($\tau_{min}$) and maximum ($\tau_{max}$) of slot time ($\tau_s$) for driving the liquid crystal display device with accuracy are given by equations (11) and (12), respectively.

$$\tau_{min}=\mathrm{MAX}(\tau_e,\tau_w) \tag{11}$$

$$\tau_{max}=\tau_n \tag{12}$$

The broken lines 23 and 24 in FIG. 4 show the maximum and minimum of the slot time in the JOERS/Alvey drive scheme as one kind of the above-mentioned two-field drive scheme, respectively, for comparison purposes. In the case of driving by the two-field drive scheme, the minimum of the slot time is given by the minimum response time to the writing voltage.

As shown in FIG. 4, when M=2, i.e., when the duration of the blanking period is equal to the duration of the selecting period, it is said that $\tau_e>\tau_w$. According to equation (11), $\tau_{min}=\tau_e$. In this case, as is clear from FIG. 4, $\tau_{min}$ is present above the broken line 24, and $\tau_{max}$ is present below the broken line 23. It is thus known that the tolerance of $\tau_s$ is narrower compared to the two-field drive scheme (JOERS/Alvey drive scheme).

Compared to the two-field drive scheme in which the number of times of scanning each scanning electrode in one frame period is twice, in the blanking drive scheme of this embodiment, the number of times of scanning is once. Therefore, considering only the effect produced by a reduction in the number of times of scanning, the blanking drive scheme can achieve a faster driving speed than by the two-field drive scheme. However, as described above, when M=2, the duration of the selecting period of each scanning electrode becomes longer due to a rise in the minimum of the slot time compared to the two-field drive scheme. Thus, it is hard to say that driving is performed at a sufficiently high speed. Moreover, since the tolerance of $\tau_s$ is narrower, the blanking drive scheme has a drawback that the temperature range in which accurate driving can be performed is narrow.

In contrast, when M≧4, since the relationship between the curves 21 and 22 becomes opposite, i.e., $\tau_e<\tau_w$, it is said that $\tau_{min}=\tau_w$ according to equation (11). Additionally, as is clear from a comparison between the value of $\tau_w$ and the broken line 24, in the drive scheme of this embodiment, the minimum of the slot time is smaller than that in the JOERS/Alvey drive scheme when M≧4. Namely, it is possible to achieve driving at still higher speeds by the multiplier effect produced by a reduction in the number of times of scanning in one frame period and a further decrease in the minimum of the slot time. Furthermore, when M≧4, compared to the case when M=2, the tolerance of $\tau_s$ is wider, thereby allowing driving at even wider temperature range.

For example, when the blanking period is arranged to be three slots (M=3) or 1.5 times longer than the selecting period, two cases exist depending on the content of the data signal: in one case, the blanking voltage corresponding to two slots is present in the three-slot blanking period; in the other case, the blanking voltage corresponding to one slot is only present in the three-slot blanking period. In the former case, the response time $\tau_e$ is improved, and an effect of widening the tolerance of $\tau_s$ is exhibited. On the other hand, the latter case does not has such an effect. Moreover, if the value of M is not an integer, i.e., for example, when the blanking period is 1.8 times longer than the selecting period, it is necessary to vary the clock frequency for output control of the scanning signal. Consequently, the control of the driving system becomes complicated, and therefore M representing a value which is not an integer is not preferred. Accordingly, the value of M is preferably an integer multiple of the number of slots in the selecting period and not less than four.

As is known from the description above, in order to render the number of slots of the blanking voltage generated in the blanking period greater than the number of slots of the writing voltage generated in the selecting period irrespectively of the contents of the data signal, it is necessary to arrange the number of slots in the blanking period to be at least twice larger than the number of slots in the selecting period.

FIG. 4 shows the results of measurement when K representing the number of slots between the blanking period and the selecting period was 6. However, even when K was set to higher values, such as 8 and 10, substantially the same result was obtained. As the value of M increases, the values of $\tau_e$ and $\tau_w$ gradually decrease. However, the value of $\tau_{min}$ does not vary even when M becomes larger than 4. For the reasons mentioned above, it can be said that the above-mentioned effect is exhibited by arranging the duration of the blanking period to be at least twice that of the selecting period.

The reason why $\tau_e$ becomes smaller than $\tau_w$ by arranging the duration of the blanking period to be at least twice that of the selecting period is as follows.

For example, when the blanking period is twice longer than the selecting period, in the pixel voltage to be applied to the pixel during the blanking period, the blanking voltage corresponding to two slots is always present in the blanking period irrespectively of the patterns of the data signal to be applied to the signal electrode 2 in this blanking period. Known effects of the waveform of the drive pulse on the response speed of FLC are as follows. Specifically, when a comparison is made between a case where several slots of drive pulses including one slot of blanking voltage (or writing voltage) are given and a case where drive pulses of the same number of slots as the above-mentioned drive pulses including two slots of blanking voltage (or writing voltage) are given, it is clear that switching of alignment is more likely to occur in the latter case, thereby improving the response speed, i.e., narrowing the slot width. This characteristic becomes stronger as the number of slots of the blanking voltage (or writing voltage) included in the drive pulses increases. For the reasons mentioned above, it is possible to render $\tau_e$ smaller than $\tau_w$ by arranging the duration of the blanking period to be at least twice that of the selecting period.

Moreover, as shown by the curve 21 and the broken line 24 in FIG. 4, in the blanking drive scheme, compared to the two-field drive scheme, the response time $\tau_w$ to the writing voltage in the selecting period decreases because the switching of the alignment of FLC molecules in the blanking period affects the switching characteristic in the selecting period after the blanking period. Namely, it has been understood that the generation of opposite electric field due to the application of the blanking voltage and a delay in the active response of the FLC molecules increases the response speed to the writing voltage in the selecting period.

Furthermore, in the structure of this embodiment, the pulse height of the compensating pulse for averaging the DC components of the pixel voltage to be applied to the pixel in one frame period is about several tens mV that is sufficiently smaller than that of strobe pulse or other pulse (several tens V), and the compensating pulse is applied to the scanning electrode 1 after the selecting period. Therefore, the average of the pixel voltage to be applied to the pixel in one frame period can be made zero without affecting the switching operation in the selecting period, thereby preventing electrochemical degradation of ferroelectric liquid crystal in the pixel region.

Embodiment 2

The following description will discuss another embodiment of the present invention with reference to FIGS. 3, 5, 6 and 10. The members having the same function as in Embodiment 1 above will be designated by the same code and their description will be omitted.

A liquid crystal display device of this embodiment is substantially the same as the liquid crystal display device of Embodiment 1 in the device structure, but the waveform of the scanning signal to be applied to the scanning electrode 1 differs from that in Embodiment 1. More specifically, as illustrated in FIG. 3, this liquid crystal display device includes a scanning electrode driving circuit 33 that is operated in the manner described below, instead of the scanning electrode driving circuit 13 of Embodiment 1.

Figure 5:
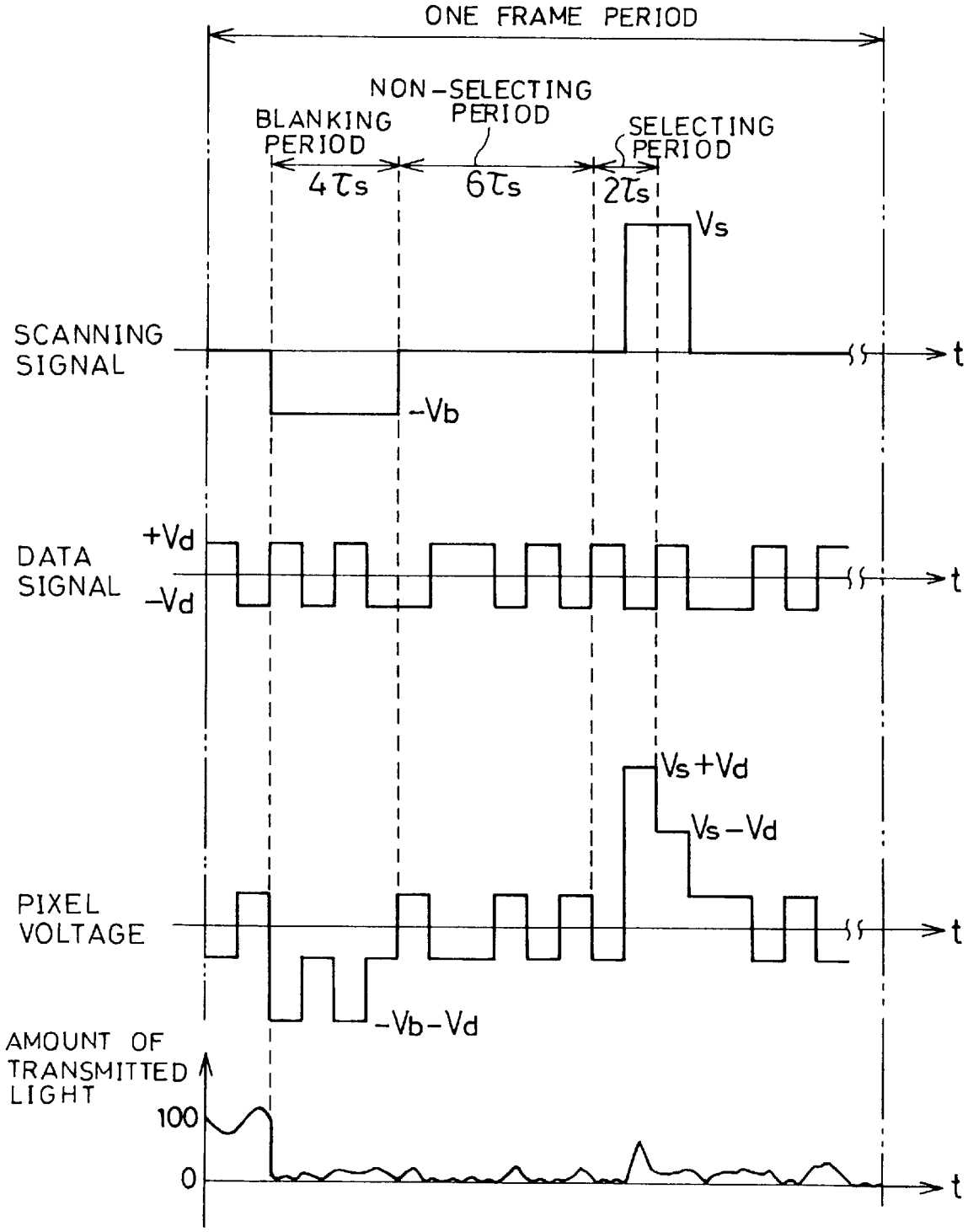
FIG. 5 is a view explaining an example of the waveform of a scanning signal, data signal, and pixel voltage produced at a pixel by these signals in a liquid crystal display device according another embodiment of the present invention, against the amount of transmitted light at the pixel to which the pixel voltage is applied.

The waveform of the scanning signal to be applied to the scanning electrode 1 by the scanning electrode driving circuit 33 is shown as the top waveform in FIG. 5. It is clear from FIG. 5 that the scanning electrode driving circuit 33 applies to the scanning electrode 1 a scanning signal including a blanking pulse with a pulse width of four slots ($4\tau_s$) and a strobe pulse with a pulse width of two slots ($2\tau_s$) in one frame period. The one frame period corresponds to a period during which all of the scanning electrodes 1 are selected once.

Moreover, the scanning signal includes a non-selecting period of six slots ($6\tau_s$) between the blanking period and the selecting period. The duration of the non-selecting period between the blanking period and the selecting period is not necessarily limited to six slots, but is at least three times that of the selecting period.

The line address time to the respective scanning electrodes, i.e., the selecting period, is two slots. The second slot in the selecting period corresponds to the first slot of the strobe pulse. More specifically, a voltage is applied to the scanning electrode 1 so that the voltage is 0 V in the first slot of the selecting period and the voltage is $V_s$ in the second slot thereof. Moreover, the second slot of the strobe pulse is applied to the scanning electrode 1 in a period of one slot following the selecting period.

The polarity of the blanking pulse is opposite to the strobe pulse, and the pulse height thereof is $V_b$. The relationship between the pulse height of the blanking pulse and the pulse height of the strobe pulse is written:

$$V_s=2V_b$$

An example of the waveform of the data signal to be applied to the signal electrode 2 is shown as the second waveform from the top of FIG. 5. Like the data signal of Embodiment 1, this data signal is formed by bipolar pulses with an amplitude $V_d$ having a cycle of two slots. In the case of writing, the data signal has a writing pattern in which the first slot is $-V_d$, and the second slot is $+V_d$. On the other hand, in the case of non-writing, the data signal has a non-writing pattern in which the first slot is $+V_d$ and the second slot is $-V_d$.

The potential difference between the scanning signal applied to the scanning electrode 1 and the data signal to be applied to the signal electrode 2 is applied to the pixel as a pixel voltage for driving the pixel. Namely, the writing voltage is $V_s-V_d$, and the non-writing voltage is $V_s+V_d$. In order to equalize the pulse heights of the writing voltage and the blanking voltage, the following relationship is established like Embodiment 1.

$$V_s:V_b:V_d=4:2:1$$

The waveform of pixel voltage produced by the scanning signal shown as the top waveform in FIG. 5 and the data signal shown as the second waveform from the top is shown as the third waveform from the top in FIG. 5.

In this case, as is clear from a graph representing the amount of transmitted light shown at the bottom in FIG. 5, the blanking voltage in the blanking period turns the pixel into the dark display state in which substantially no light is transmitted. The vertical axis of the graph representing the amount of transmitted light indicates the amount of transmitted light as zero when the FLC molecules in the pixel region are aligned to form one of bistable states, and as 100 when the FLC molecules in the pixel region is aligned to form the other state.

When the waveform of the data signal to be applied to the signal electrode 2 in the selecting period exhibits the non-writing pattern as shown by the second waveform from the top of FIG. 5, switching is not effected, and the display state of pixel persists in the dark state of the blanking period.

As explained above, in the scanning signal to be applied to the scanning electrode 1 by the scanning electrode driving circuit 33, when the strobe pulse has a width of not less than two slots, if the duration between the blanking period and the selecting period is arranged to be at least three times that of the selecting period, it is possible to accurately blank the pixel in the blanking period and retains the display state of the pixel when the data signal in the following selecting period is non-writing data, thereby achieving good display contrast.

Figure 6:
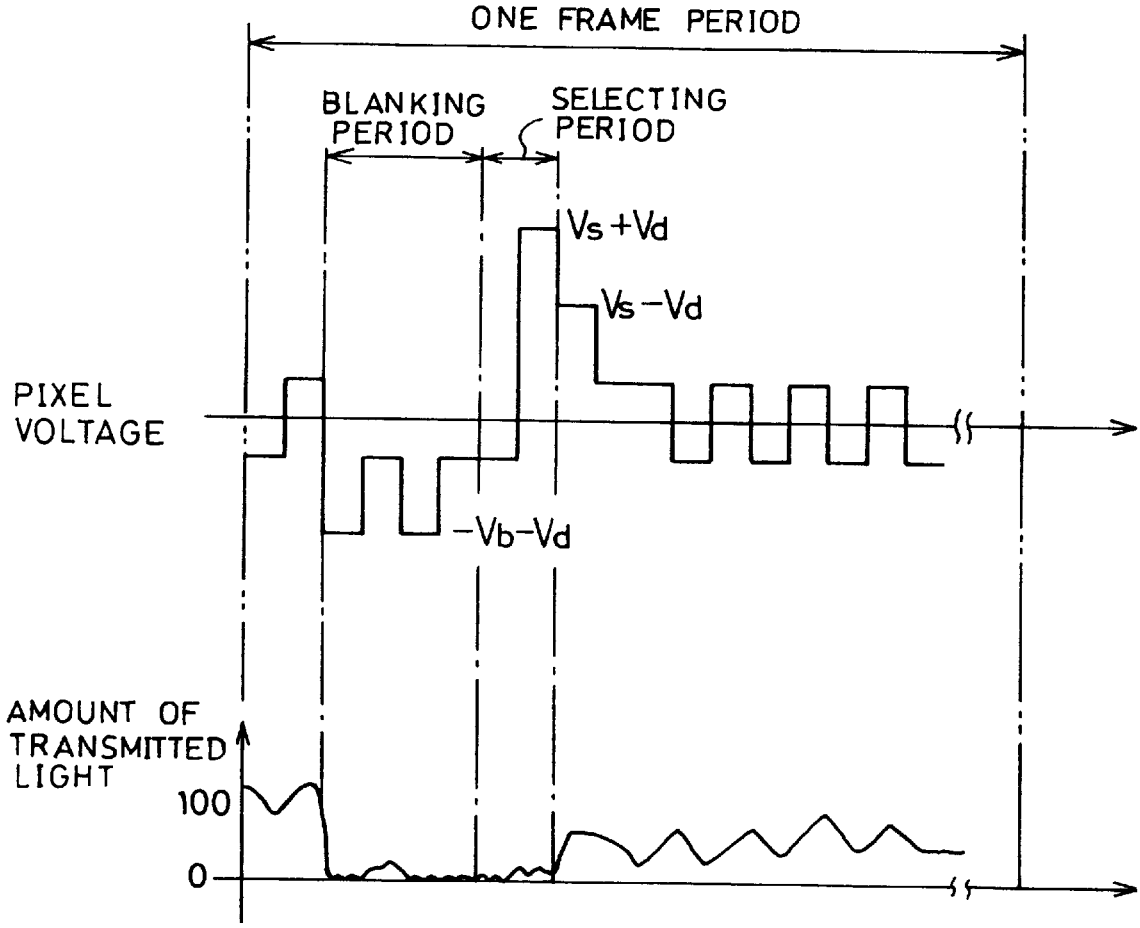
FIG. 6 is a view explaining a pixel voltage when a selecting period is given immediately after a blanking period against the amount of transmitted light at the pixel to which the pixel voltage is applied, as a comparative example of the liquid crystal display device.
Figure 7A:
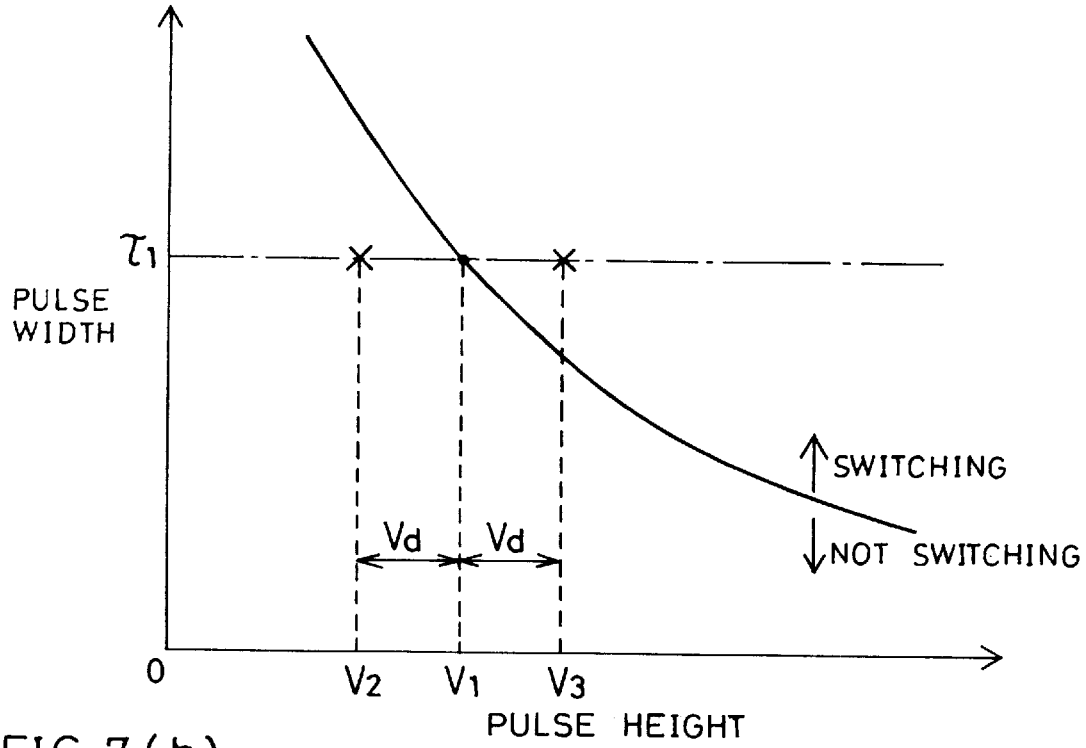
FIG. 7(*a*) is the $\tau$–V characteristic of ferroelectric liquid crystal having positive dielectric anisotropy, and FIG. 7(*b*) is the $\tau$–V characteristic of ferroelectric liquid crystal having negative dielectric anisotropy.
Figure 7B:
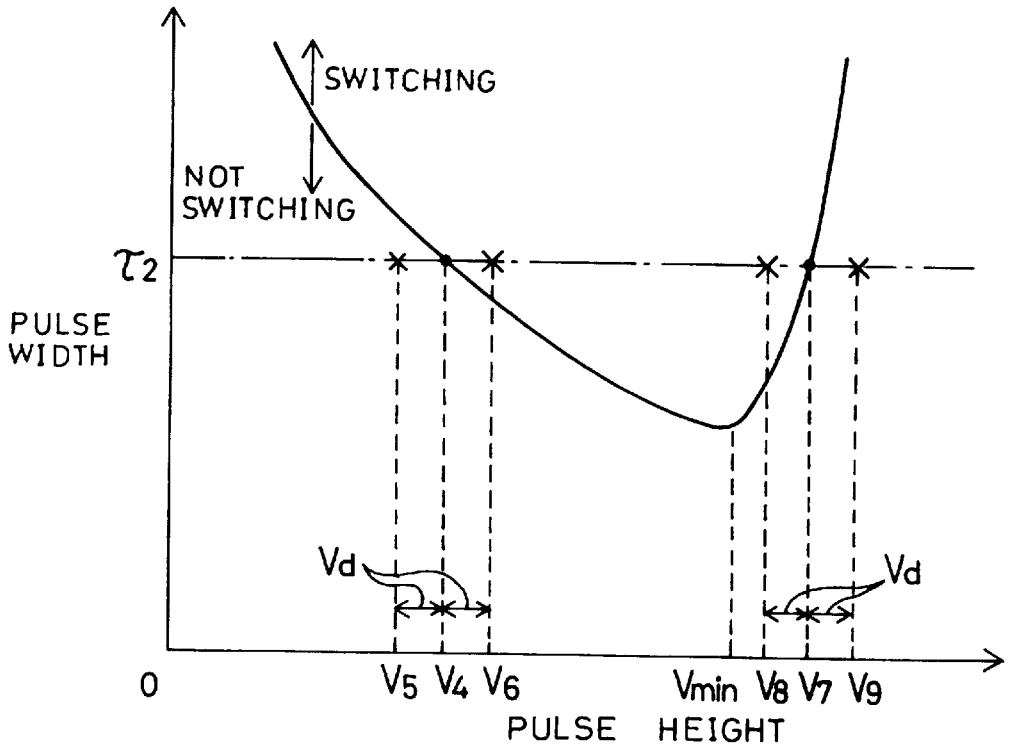
Figure 8:
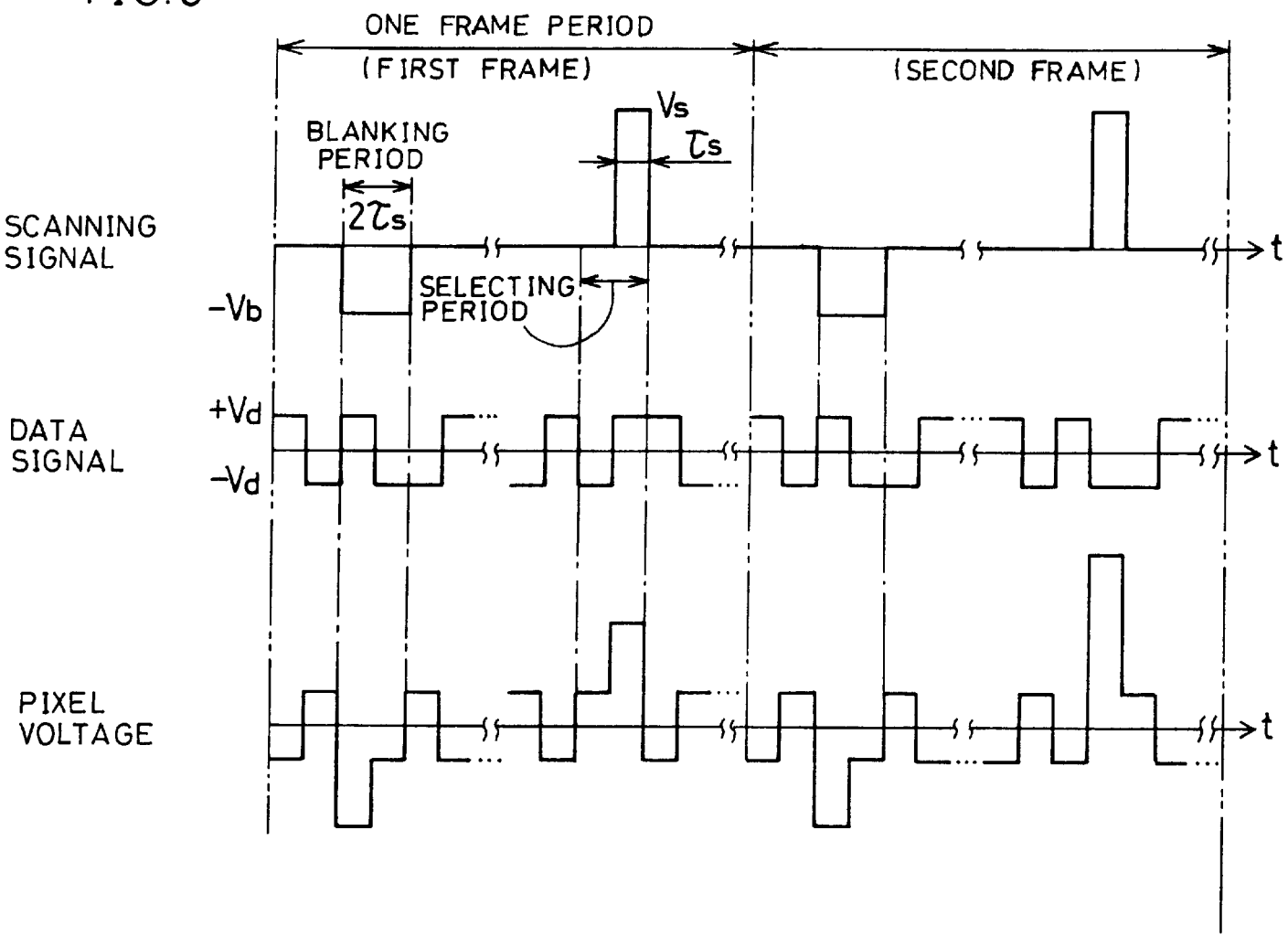
FIG. 8 is a waveform chart showing en example of the scanning signal, data signal, and pixel voltage in a blanking drive scheme adapting the conventional two-field drive scheme.
Figure 9:
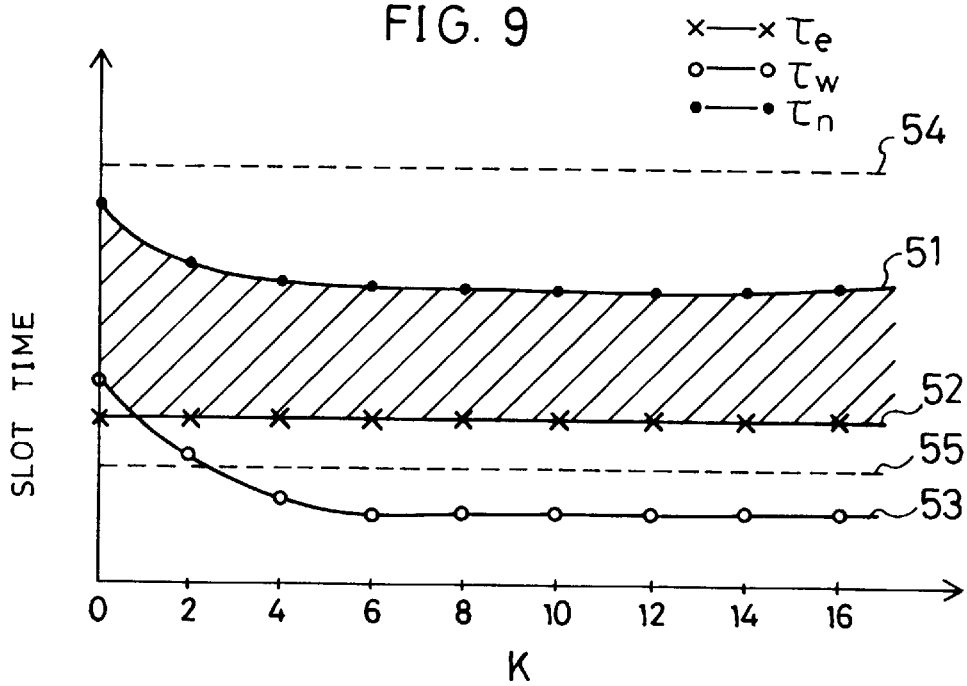
FIG. 9 is a graph showing the tolerance of slot time when a liquid crystal display device is driven by the blanking drive scheme.

In order to simplify the explanation of the effect exhibited by the above-mentioned structure, a comparative example will be given. FIG. 6 shows a graph indicating the amount of transmitted light at the pixel and an example of the waveform of the pixel voltage as a comparative example wherein the pulse height and the width of each pulse are the same as those in the above-mentioned structure and the number of slots in the non-selecting period between the blanking period and the selecting period is zero.

As is clear from FIG. 6, when the number of slots in the non-selecting period between the blanking period and the selecting period is set to zero, undesired switching is effected by the writing voltage of $V_s-V_d$ right after the selecting period, resulting in a lowering of the contrast ratio. This phenomenon is caused since switching is easily effected after the blanking period due to the effect of switching in the blanking period. More specifically, it has been understood that the generation of opposite electric field due to the blanking voltage and a delay in the active response of the FLC molecules switch the state of the FLC molecules more easily compared to the case where the blanking voltage is not present.

This phenomenon is not always exhibited when the data signal in the selecting period shows the non-writing pattern, but is observed when the data signal of the writing pattern is applied immediately after the selecting period. The phenomenon is particularly significant in a case where the waveform of the pixel voltage immediately after the selecting period includes writing voltages of successive two slots. In order to avoid undesired switching in such a case, the following two arrangements may be made:

(1) reducing the slot time, and (2) preventing a switching caused by the blanking voltage from affecting a switching/non-switching in the selecting period by increasing the duration between the blanking period and the selecting period.

In arrangement (1), there is a possibility of a side effect that a switching is not effected by the writing pattern where the switching should be effected. Therefore, arrangement (2), i.e., increasing the duration between the blanking period and the selecting period, is preferred as described in this embodiment.

The amount of transmitted light was measured by changing the value of the number, K, of slots in the non-selecting period between the blanking period and the selecting period. It is found from the measurement results that as the value of K increases, the occurrence of spurious switching with respect to the non-writing pattern is reduced, and a good contrast ratio is obtained. The allowable minimum contrast ratio is obtained when the value of K is six.

In this embodiment, the case in which the width of the strobe pulse is two slots is explained as an example. However, even when the width of the strobe pulse is three slots or more, it is also possible to obtain an allowable contrast ratio by arranging the number of slots in the non-selecting period between the blanking period and the selecting period to be at least three times that in the selecting period. However, if the duration between the blanking period and the selecting period is increased to an unlimited extent, flicker and a lowering of the contrast ratio occur due to the switching timing. Therefore, in an actual practice, the duration is preferably not greater than 1 ms.

Figure 10:
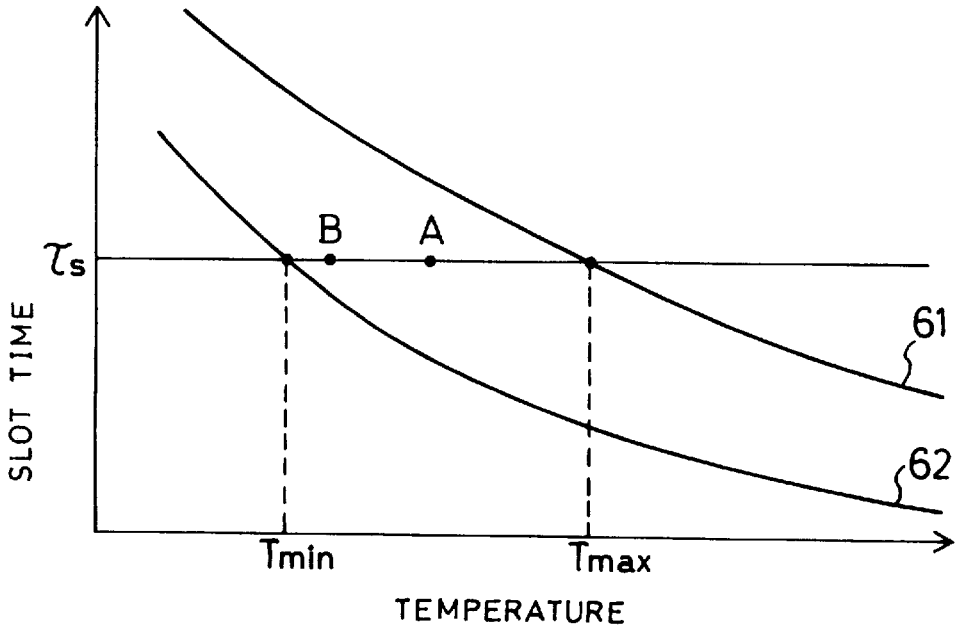
FIG. 10 is a graph showing a change in the slot time of ferroelectric liquid crystal depending on ambient temperature.

Moreover, in general, in a liquid crystal panel using ferroelectric liquid crystal, there is a temperature difference of a maximum of around 3° C. within the liquid crystal panel because the liquid crystal panel generates heat by itself when driven and heat is radiated by the backlight. The driving characteristic of FLC against temperature is shown in FIG. 10. As illustrated in FIG. 10, at temperature A located in the middle of the operable temperature range, the liquid crystal panel 10 may be driven for a slot time $\tau_s$ based on the premiss, K=0, without lowering the contrast ratio. However, at temperature B shown in FIG. 10, since the slot time $\tau_s$ is close to the minimum of the slot time represented by the curve 62, a spurious switching tends to occur. In this case, an allowable contrast ratio can be obtained by setting the value of K to six or higher values.

As described above, the structure of this embodiment is characterized by that, when the width of the strobe pulse is two slots or more, the duration of the non-selecting period between the blanking period and the selecting period is arranged to be at least three times that of the selecting period. This arrangement prevents the switching effected by the blanking voltage in the blanking period from affecting a switching/non-switching in the selecting period, thereby avoiding a spurious switching of the non-writing pattern in the selecting period. Consequently, it is possible to perform high-speed driving by the blanking drive scheme in which one frame period is formed by one field, without lowering the contrast ratio.

The above-mentioned embodiments are not given for the purpose of limiting the present invention, and therefore various modification can be made within the scope of the invention. The above-explanation was made by referring an example in which the pixel is displayed in the dark state as a result of blanking in the blanking period. However, the pixel may be displayed in the bright state.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display apparatus comprising:

a first substrate having a plurality of parallel scanning electrodes arranged thereon;

a second substrate having a plurality of parallel signal electrodes arranged thereon to cross said scanning electrodes at right angles;

a ferroelectric liquid crystal with negative dielectric anisotropy sandwiched between said first and second substrates;

scanning electrode driving means for applying to said scanning electrodes a scanning signal having a cycle of one frame period during which all of said scanning electrodes are selected once, said scanning signal including a strobe pulse in a selecting period, and a blanking pulse as a unipolar pulse having opposite polarity to said strobe pulse, a width which is at least twice longer than said selecting period, and a uniform pulse height in a blanking period located before said selecting period; and signal electrode driving means for applying a data signal to said signal electrodes, said data signal including writing data and non-writing data represented by bipolar pulses having a duration equal to said selecting period, a uniform pulse height, and different waveforms, wherein when said data signal represents the writing data, a potential difference between said scanning signal and said data signal in a slot synchronous with said strobe pulse is a writing voltage for changing an alignment of said ferroelectric liquid crystal to one of bistable states, when said data signal represents the non-writing data in the slot, the potential difference is a non-writing voltage which does not change the alignment of said ferroelectric liquid crystal, and a potential difference between said blanking pulse and said data signal includes a blanking voltage for changing the alignment of said ferroelectric liquid crystal to the other state of said bistable states.

2. The liquid crystal display apparatus according to claim 1, wherein said scanning electrode driving means applies to said scanning electrode a compensating pulse having a polarity opposite to said blanking pulse and a pulse area equal to a difference between a pulse area of said blanking pulse and a pulse area of said strobe pulse.

3. The liquid crystal display apparatus according to claim 1, wherein $$T_b = n \times T_s$$

where $T_b$ is a duration of said blanking period, $T_s$ is a duration of said selecting period, and n is an integer not smaller than two.

4. The liquid crystal display apparatus according to claim 1, wherein said non-writing voltage is higher than said writing voltage.

5. The liquid crystal display apparatus according to claim 1, wherein $$V_b/V_s = 0.5$$

where $V_b$ is a pulse height of said blanking pulse, and $V_s$ is a pulse height of said strobe pulse.

6. The liquid crystal display apparatus according to claim 1, wherein said writing voltage and said blanking voltage have the same pulse height.

7. The liquid crystal display apparatus according to claim 1, wherein $$V_s : V_b : V_d = 4:2:1$$

where $V_s$ is a pulse height of said strobe pulse, $V_b$ is a pulse height of said blanking pulse, and $V_d$ is a pulse height of the bipolar pulse of said data signal.

8. A liquid crystal display apparatus comprising:

a first substrate having a plurality of parallel scanning electrodes arranged thereon;

a second substrate having a plurality of parallel signal electrodes arranged thereon to cross said scanning electrodes at right angles;

a ferroelectric liquid crystal with negative dielectric anisotropy sandwiched between said first and second substrates;

scanning electrode driving means for applying to said scanning electrodes a scanning signal having a cycle of one frame period during which all of said scanning electrodes are selected once, said scanning signal including a strobe pulse in a part of a selecting period of said scanning electrode and a predetermined period that follows said selecting period, and a blanking pulse having opposite polarity to said strobe pulse in a period before said selecting period; and signal electrode driving means for applying a data signal to said signal electrodes, said data signal including writing data and non-writing data represented by bipolar pulses having a duration equal to said selecting period, a uniform pulse height, and different waveforms, wherein when said data signal represents the writing data, a potential difference between said scanning signal and said data signal in a slot synchronous with said strobe pulse is a writing voltage for changing an alignment of ferroelectric liquid crystal to one of bistable states, when said data signal represents the non-writing data in the slot, the potential difference is a non-writing voltage which does not change the alignment of ferroelectric liquid crystal, a potential difference between said blanking pulse and said data signal includes a blanking voltage for changing the alignment of ferroelectric liquid crystal to the other state of said bistable states, and a non-selecting period which is at least three times longer than said selecting period is present between said blanking pulse and said selecting period.

9. The liquid crystal display apparatus according to claim 8, wherein $$T_n = n \times T_s$$

where $T_n$ is a duration of said non-selecting period, $T_s$ is a duration of said selecting period, and n is an integer not smaller than three.

10. The liquid crystal display apparatus according to claim 8, wherein $$|V_b/V_s| = 0.5$$

where $V_b$ is a pulse height of said blanking pulse, and $V_s$ is a pulse height of said strobe pulse.

11. The liquid crystal display apparatus according to claim 8, wherein said writing voltage and said blanking voltage have the same pulse height.

12. The liquid crystal display apparatus according to claim 8, wherein $$V_s : V_b : V_d = 4:2:1$$

where $V_s$ is a pulse height of said strobe pulse, $V_b$ is a pulse height of said blanking pulse, and $V_d$ is a pulse height of the bipolar pulse of said data signal.

13. The liquid crystal display apparatus according to claim 8, wherein a pulse area of said strobe pulse is equal to a pulse area of said blanking pulse.

14. The liquid crystal display apparatus according to claim 1, wherein a pulse area of said strobe pulse is equal to a pulse area of said blanking pulse.

* * * * *